United States Patent [19]

Hagg et al.

[11] 4,195,677

[45] Apr. 1, 1980

[54] GOLF CLUB COVER

[76] Inventors: Wilbert F. Hagg, 1815 Port Seabourne Way, Newport Beach, Calif. 92660; Henry W. Hagg, 2833 Serang Pl., Costa Mesa, Calif. 92626

[21] Appl. No.: 15,117

[22] Filed: Feb. 26, 1979

[51] Int. Cl.[2] ..... B65D 65/02

[52] U.S. Cl. ..... 150/52 G

[58] Field of Search ..... 150/52 G, 1.5 R; 206/315 R

[56] References Cited

U.S. PATENT DOCUMENTS

| | | | |
|---|---|---|---|
| 2,128,546 | 8/1938 | Venmore | 150/52 G UX |
| 2,879,819 | 3/1959 | Turnbull | 150/52 G UX |
| 3,568,916 | 3/1971 | Scheuring | 229/45 EC |
| 3,641,697 | 2/1972 | Heidtman | 206/315 X |
| 3,664,399 | 5/1972 | Neff | 150/52 G X |

*Primary Examiner*—Donald F. Norton

*Attorney, Agent, or Firm*—I. Michael Bak-Boychuk

[57] ABSTRACT

Set out herein is a golf club protector conformed as an integral structure including the club tubes normally found in a golf bag, the protector or cover comprising a clam shaped upper end conformed to receive the golf club on the interior thereof. More specifically, the clam shaped cover includes a lower surface integrally attached to one end of the tube, the lower surface being in turn pivotally engaged to a mating upper surface provided with a snap lock at the free edge thereof. More specifically, the upper clam surface is pivoted from the edge of the tube, the peripheral edge thereof being formed to mate with the peripheral edge of the lower surface. Thus a hollow structure is formed which, when closed, will protect the club head from the elements and which, when opened, will permit the withdrawal of the club.

3 Claims, 5 Drawing Figures

FIG. 1
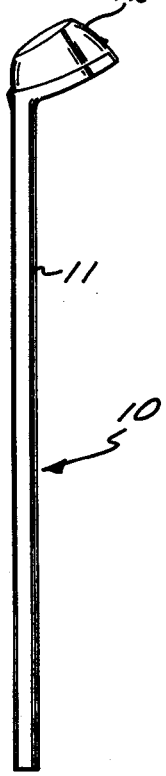
FIG. 2
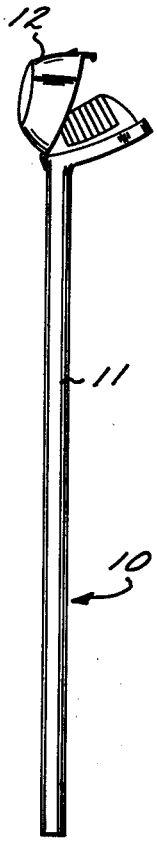
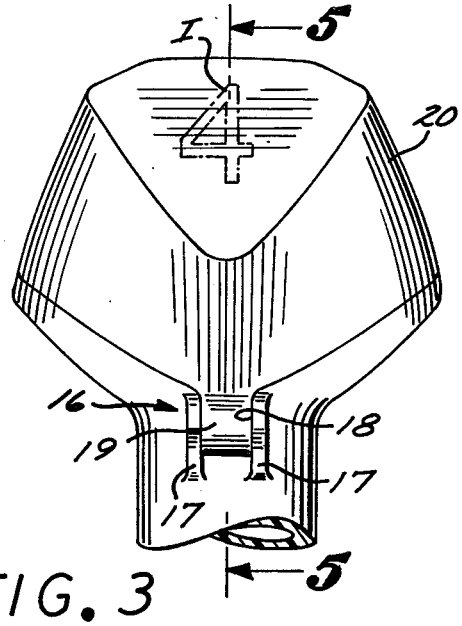
FIG. 3
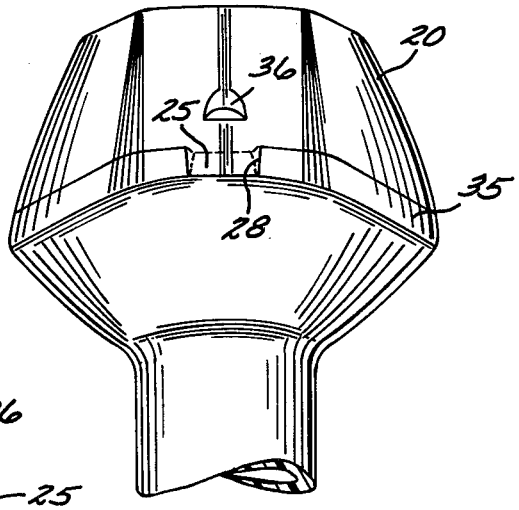
FIG. 4
FIG. 5
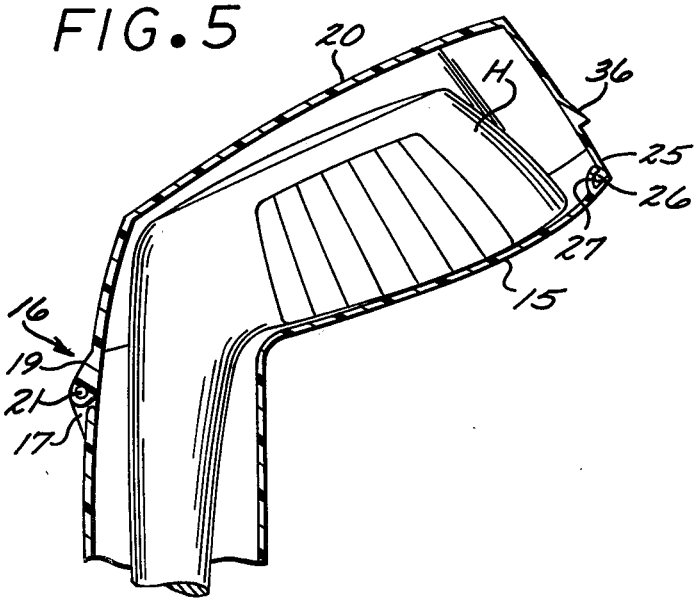

GOLF CLUB COVER

BACKGROUND OF THE INVENTION

1. Field of the Invention

The present invention relates to golf devices and more particularly to rigid enclosures for protecting golf clubs.

2. Description of the Prior Art

In typical practice a conventional golf bag normally includes a plurality of separator tubes each conformed to receive the shank of a particular club. As the clubs are thus positioned in the tubes, the club heads are then conventionally covered with a sock or a similar flexible device. In the ordinary course of play, therefore, as the player selects and withdraws a particular club, he must concurrently remove the separate sock and find temporary storage therefor. To identify the club size each sock is typically provided with the club number and therefore substantial care must be exercised in withdrawing and storing the socks. This housekeeping effort quite often detracts from the enjoyment of the game, the player often finding himself searching for the stored club protector and in the course of this search often loses concentration over the play. Thus a structure which integrally stores and seals the golf club and which does not require temporary separation and maintenance is desired both for the convenience of the player and to reduce the paraphernalia involved in the play.

SUMMARY OF THE INVENTION

Accordingly, it is the general purpose and object of the present invention to provide a golf club protecting device conformed as the conventional club separator tube which furthermore includes a releasable cover at the upper end thereof for protecting the club head.

Other objects of the invention are to provide a golf head protective housing at the end of a club separator tube which by virtue of its structure may be conveniently opened or closed.

Yet additional objects of the invention are to provide a golf club protecting device which in its structure shields substantially all of the golf club surfaces from the elements.

Briefly these and other objects are accomplished by providing at the upper end of a club separator tube a clam shell type housing conformed to receive on the interior thereof the club head. The housing itself is generally conformed as a lower clam surface extending radially from the separator tube end, the lower clamp surface being hinged to an upper clam surface which together therewith forms an enclosure. The upper clam surface may include a cantelevered tab provided with an inwardly directed edge bead which may be engaged in a corresponding serration formed in the lower clam surface. Thus the edge bead, by spring deformation, will provide the necessary engagement of the upper surface relative the lower surface completing the closure. When the withdrawal of clubs stored therein is desired, the two halves of the cover may be separated by an exteriorly directed tab and may be thus hinged open for withdrawal. The hinged connection of the upper surface to the lower surface insures an integral structure with the corresponding separator tube, thus reducing the number of loose parts which have to be maintained in the course of play. The upper surface, furthermore, may be provided with the necessary exterior inscriptions to identify the clubs received therein, thus insuring for an organized storage arrangement. The separator tube may be left open at the bottom end thereof and thereby clubs of various shaft lengths and various head configurations may be stored therein.

BRIEF DESCRIPTION OF THE DRAWINGS

FIG. 1 is a side view of the inventive golf club protective device illustrated in the closed alignment thereof;

FIG. 2 is yet another side view of the inventive golf club protective device illustrating the articulation thereof for withdrawal of the club;

FIG. 3 is a rear view, in partial detail, illustrating the hinging alignment of the inventive golf club protective device;

FIG. 4 is a detail front view illustrating the latching configuration of the protective device set out herein; and FIG. 5 is a sectional view, in detail, taken along line 5—5 of FIG. 3.

DESCRIPTION OF THE SPECIFIC EMBODIMENT

As shown in FIGS. 1–5 the inventive golf club cover, generally designated by the numeral 10, comprises a conventional club separator tube 11 joined at the upper end thereof to a clam shell club head housing 12. Housing 12 comprises a lower housing half 15 convolved as a dished surface extending in partial cantelever from the upper end of the separator tube 11. The dimensions of the lower half 15 are conformed to the exterior dimensions of a club head H and will thus receive and support the club on the interior thereof. In this form the surface of the lower half 15 extends to one side of the tube 11, the other edge of the tube 11 forming a hinge 16 pivotally attaching an upper mating housing half 20. In order to provide the requisite structural stiffness and integrity, hinge 16 is achieved by way of two longitudinal ribs 17 formed on the exterior of the tube adjacent either side of a rectangular cut-out 18 conformed to receive a pivoted extension 19 therein. Extension 19 is formed as an integral part of the exterior surface of the upper half 20, thus providing support therefor. To complete the hinge, a pin 21 is extended through ribs 17 and the extension 19 and it is around this pin 21 that the pivotal motion of the upper half 20 is achieved.

Formed on the opposite edge of the upper half 20 is yet another extension 25 terminating in an inwardly directed lip 26 adapted to engage a recessed tab 27 formed in the subjacent surface of the lower half 15. To accommodate the alignment of extension 25 over the tab 27 a rectangular recess is formed in the peripheral edge of the lower half 15, shown herein as recess 28. More specifically, the lower half 15 is provided with a peripheral edge stripe 35 and it is this edge strip that mates with the corresponding edge of the upper half 20. It is in this edge strip 35 that the foregoing recess 28 is formed, the tab 27 being set in to complete the edge structure. It is contemplated to form the foregoing housing 12 out of a plastic material structure, the upper half 20 being conformed to surround the exposed surfaces of the head H as it is received in the lower half 15. Furthermore, the outward alignment of ribs 17 and the corresponding outward alignment of the pivotal extension 19 complement the inward alignment of lip 26, thus facilitating the withdrawal from a mold of the upper half 20. Similarly, the alignment of the recess tab 27 is inward and in the direction of ribs 17, once more allowing for the withdrawal of the molded structure comprising the lower half 15 and tubes 11.

The foregoing structure thus is conveniently cast, requiring the only additional assembly step of the of insertion pin 21. Once the pin is inserted the flexure and elastic deformation of extensions 19 and 25 will allow for the repeated closure and opening of the two housing halves. To further facilitate opening of the housing against the elastic bias there is provided on the exterior of the upper half 20 a finger engaging projection 36 and it is by way of this projection 36 that release can be effected to allow the withdrawal of the club.

The foregoing structure may include inscriptions on the exterior of the upper half 20, shown herein as an inscription I, this inscription identifying the club received and housed in the assembly.

It is to be understood that the foregoing structure is most commonly adaptable to the storage of woods, clubs of this kind requiring the highest protection against the elements. It is further contemplated to provide sufficient clearance on the interior of the housing 12 to accommodate both left hand and right hand clubs. Thus a single molding may be utilized for the necessary structure, the simple expedient of inscription allowing for the varied use thereof.

Obviously many modifications and changes can be made to the foregoing description without departing from the invention. It is therefore intended that the scope of the invention be determined solely on the claims appended hereto.

What is claimed is:

1. A golf club covering device comprising:

a cylindrical tube adapted to receive the shaft of said golf club;

a dished lower surface projection extending from the upper edge of said tube and aligned in cantilever to support and partly enclose the head of said club, said lower surface projection including a lower peripheral mating edge partly extending thereabout;

a dished upper surface hingedly connected proximate said tube to said lower peripheral mating edge for pivotal motion about said tube, said upper surface including an upper peripheral mating edge conformed to mate with said lower edge; and clasp means formed on said upper surface for engaging said lower peripheral edge when said upper and lower edges are aligned for mating engagement.

2. Apparatus according to claim 1 wherein:

said tube, upper surface and lower projection each comprise flexible plastic structure.

3. Apparatus according to claim 2 wherein:

said clasp means includes an inwardly directed bead at the free end of said upper edge conformed to be displaced over a lip formed in said lower edge.

* * * * *